US007726297B2

(12) United States Patent
Feisthammel et al.

(10) Patent No.: US 7,726,297 B2
(45) Date of Patent: Jun. 1, 2010

(54) ELECTROMECHANICAL MOMENTARY-CONTACT SWITCH HAVING TIMED SUPPLEMENTARY FUNCTIONS

(75) Inventors: Egon Feisthammel, Rastatt (DE); Dieter Rosmann, Stuttgart (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 14 days.

(21) Appl. No.: 10/873,383

(22) Filed: Jun. 21, 2004

(65) Prior Publication Data

US 2004/0263298 A1 Dec. 30, 2004

Related U.S. Application Data

(63) Continuation of application No. PCT/EP02/13457, filed on Nov. 28, 2002.

(30) Foreign Application Priority Data

Dec. 21, 2001 (DE) ..... 101 63 193

(51) Int. Cl.
*H01H 9/00* (2006.01)
*H01F 7/08* (2006.01)
*F24C 15/20* (2006.01)

(52) U.S. Cl. ..... 126/299 D; 335/177; 335/179; 335/234

(58) Field of Classification Search ..... 335/177–184, 335/129–134, 229–234; 126/299 D
See application file for complete search history.

(56) References Cited

U.S. PATENT DOCUMENTS

| | | | | |
|---|---|---|---|---|
| 3,248,496 | A * | 4/1966 | Stafford | 200/451 |
| 3,675,166 | A * | 7/1972 | McCloskey et al. | 335/164 |
| 5,690,093 | A | 11/1997 | Schrank et al. | |
| 6,836,201 | B1 * | 12/2004 | Devenyi et al. | 335/229 |

FOREIGN PATENT DOCUMENTS

| | | |
|---|---|---|
| DE | 1 158 149 | 11/1963 |
| DE | 198 02 332 A1 | 7/1998 |
| EP | 0 537 700 A1 | 4/1993 |
| GB | 931341 | 7/1963 |
| GB | 2 083 207 A | 3/1982 |

* cited by examiner

*Primary Examiner*—Ramon M Barrera
(74) *Attorney, Agent, or Firm*—James E. Howard; Andre Pallapies

(57) ABSTRACT

In order to simplify and reduce the production costs of a push-button switch, especially a push switch or a rocker switch, the switch has a time function, which is manually operated and can be reset by an electric pulse. The electromechanical rocker or push-button switch can be combined to form a device block switch with other rocker or push-button switches as usually used in exhauster hoods. As a result, time-controlled intensive and follow-up steps can be carried out.

19 Claims, 4 Drawing Sheets

ELECTROMECHANICAL MOMENTARY-CONTACT SWITCH HAVING TIMED SUPPLEMENTARY FUNCTIONS

CROSS-REFERENCE TO RELATED APPLICATION

This application is a continuation, under 35 U.S.C. §120, of copending international application No. PCT/EP02/13457, filed Nov. 28, 2002, which designated the United States; this application also claims the priority, under 35 U.S.C. §119, of German patent application No. 101 63 193.6, filed Dec. 21, 2001; the prior applications are herewith incorporated by reference in their entirety.

BACKGROUND OF THE INVENTION

Field of the Invention

The present invention relates to a switching apparatus for controlling devices having at least one mechanical momentary-contact switch for mechanically switching a functionality of a device. In particular, the present invention relates to a switching apparatus for controlling the intensive stages of an extractor hood.

U.S. Pat. No. 5,690,093 A1 discloses an extractor hood having an electronic control system. The control device contains a microprocessor that drives the fan motor accordingly. The desired functions are input by a keypad. In addition to a number of pushbutton momentary contacts for various intensive stages, a pushbutton momentary contact is also provided for causing the extractor hood to continuously run. However, the pushbutton momentary contacts only act as pulse generators for the microprocessor. Purely electronic momentary-contact control is therefore provided. The manufacturing costs of electronic momentary-contact control systems of this type are relatively high.

Published, Non-Prosecuted German Patent Application DE 198 02 332 A1 discloses an electrical rocker switch in which a moveable contact part bridges stationary contacts. The moveable contact part is loaded by a spring toward one switched position and, in the other switched position, by a magnet that is in the form of a permanent magnet. The magnetic field of the permanent magnet can be influenced by the magnetic field of an electromagnet such that the moveable contact part, which is held in a prestressed state, is moved into its other switched position when the magnetic field of the electromagnet is built up.

SUMMARY OF THE INVENTION

It is accordingly an object of the invention to provide an electromechanical momentary-contact switch having timed supplementary functions that overcomes the above-mentioned disadvantages of the prior art devices of this general type, which has more favorable manufacturing costs and with which a device can be controlled.

With the foregoing and other objects in view there is provided, in accordance with the invention, a switching apparatus for controlling a device. The switching apparatus contains at least one mechanical pushbutton momentary-contact switch for mechanically switching a functionality of the device. The mechanical pushbutton momentary-contact switch can be operated manually and can be reset by an electrical pulse.

Furthermore, the above object is achieved by a switching apparatus for controlling devices having a plurality of mechanical momentary-contact switches, in particular rocker switches, for mechanically switching a plurality of functionalities of a device. At least one of the mechanical momentary-contact switches is capable of being operated manually and is reset by an electrical pulse.

The advantage of the switching apparatus according to the present invention is that a mechanical pushbutton momentary-contact switch or a momentary-contact switch combination with a timing function can be embodied, as a result of which significant cost advantages in comparison with purely electronic solutions from the prior art are obtained. Such a rocker switch or pushbutton momentary-contact switch with a timing function can be combined with further rocker switches or pushbutton momentary-contact switches and other switches to form a switch block for domestic appliances, air-conditioning units, ventilation units, miniature devices and the like.

Further advantages are that no standby-operating mode is necessary for the electromechanical momentary-contact switch according to the invention since the switch can always be actuated mechanically. As a result, the considerable consumption of energy for the standby mode can be dispensed with.

The electromechanical momentary-contact switch is also significantly less susceptible to faults than purely electronic pressure switches. In particular, the mechanical rocker switch or pushbutton momentary-contact switch can be confirmed to have a significantly higher electromagnetic compatibility with respect to electromagnetic interference.

In addition, the device that is to be actuated can be isolated clearly from the power supply system using the electromechanical momentary-contact switch. This is advantageous not only from a safety point of view but also for the configuration of further electronic components of the device.

Other features which are considered as characteristic for the invention are set forth in the appended claims.

Although the invention is illustrated and described herein as embodied in an electromechanical momentary-contact switch having timed supplementary functions, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
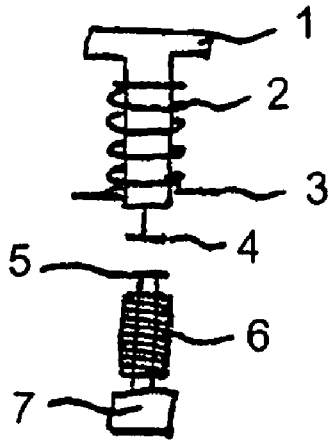
FIG. 1 is a diagrammatic, illustration of an embodiment of an electromechanical pushbutton momentary-contact switch according to the invention.

Referring now to the figures of the drawing in detail and first, particularly, to FIG. 1 thereof, there is shown a pushbutton momentary-contact switch which is held in the switched-on state after activation and can be switched off by an electrical pulse after a desired time interval. A momentary-contact element 1 is held in a sprung fashion against a housing 3, which is illustrated only in its basic form, by a helical spring 2. An electrical contact element 4 is attached to that end of the momentary-contact element 1 that lies opposite a contact surface. An electrical opposing contact 5 lies opposite the electrical contact element 4 in the direction of movement of the momentary-contact switch and is disposed on one side of a core of an electromagnet 6. A permanent magnet 7 is located at the other end of the core of the electromagnet 6.

If the momentary-contact switch is then activated manually, the electrical contact between the contact elements 4 and 5 closes so that the momentary-contact switch is in an electrical ON state. The pushbutton momentary-contact switch then stays in the ON state since the electrical contact element 4 is held by the permanent magnet 7 over the core of the electromagnet 6 counter to the spring force of the spring 2.

In order to switch the pushbutton momentary-contact switch into the OFF state, a short pulse is applied to the electro-magnet 6. The electrical pulse is in this case oriented such that its magnetic field induced in the coil of the electromagnet 6 counteracts the magnetic field of the permanent magnet 7. As a result, the magnetic force exerted on the electrical contact element 4 is reduced, so that the spring 2 pushes the momentary-contact element 1 upward, opens the electrical contact and thus moves the pushbutton momentary-contact switch into the OFF state.

The electrical pulse for the electromagnet 6 may be a control pulse from a non-illustrated control device, in particular the pulse of a time-delay switching element.

Figure 2:
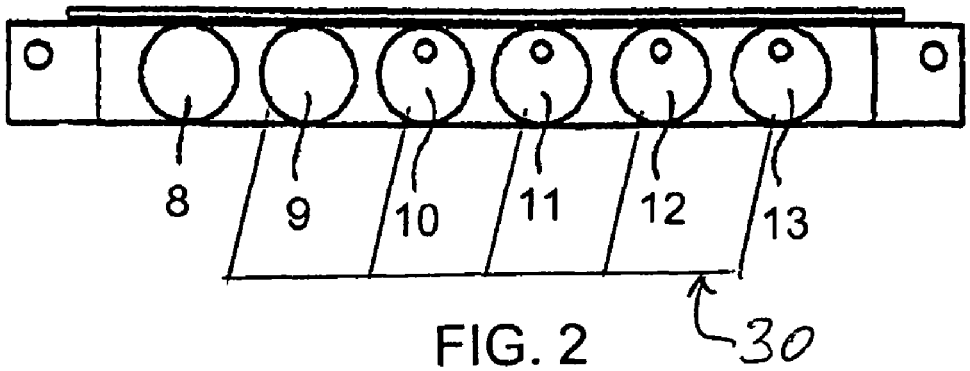
FIG. 2 is a diagrammatic, front view of a switching apparatus having a plurality of pushbutton momentary-contact switches.

FIG. 2 shows a schematic illustration of a front view of a control element of an extractor (exhaust) hood. All of the switches 8 to 13 are embodied as pushbutton momentary-contact switches. The switch 8 is used for switching the light on and off. The switch 9 is used for resetting the fan of the extractor hood or turning it off. The switches 10, 11 and 12 correspond to respective intensive stages of the fan or speed stages of the fan motor. The momentary-contact switches 9 to 12 are connected mechanically in such a way that, when a momentary-contact switch is pressed, they trigger one another and simultaneous pressing of the momentary-contact switches is mechanically prevented.

The pushbutton momentary-contact switch 13 is used to activate an intensive stage. The intensive stage signifies briefly switching higher into the maximum rotational speed range. By the intensive stage, the conventional switch block 8 to 12 is expanded by one fully functional intensive stage, using a pushbutton momentary-contact switch 13 with a timing function.

The intensive stage can be switched on in any operating state, i.e. at any speed of fan motor. It remains switched on in the predefined time period unless it is disconnected from the pushbutton momentary-contact switch by switching off (e.g. actuating switch 9) the fan motor. After the predefined time period has expired, the intensive stage deactivates itself. The device then carries on running in the originally set stage.

For an additional intensive stage, the switch for the intensive stage must be mechanically decoupled from the other switches. The momentary-contact switch 13 for the intensive stage is also preferably equipped with its own time-delay switching element.

When the intensive stage is activated, the stage that has been active until then is first switched off and only then is the intensive stage activated. As already mentioned, the intensive stage can be switched off manually at any time before the predefined time period has expired.

When the intensive stage is switched off, irrespective of whether this is done automatically or manually, the previously set stage is automatically activated, as has also already been explained. The momentary-contact switch of this stage is still in the activated position so that the operator can recognize the stage used last.

According to a further embodiment, instead of being equipped with an intensive stage, the extractor hood is equipped with a run-on or after run stage. The momentary contact switches 8 to 12 are assigned as in the first embodiment. However, the switch block is expanded by a fully functional run-on stage. In contrast to the first embodiment, the momentary-contact switch 13 for the run-on stage is mechanically connected to the other momentary-contact switches 9 to 12 by slides, 30, illustrated diagrammatically in FIG. 2, ensuring that the momentary-contact switches trigger one another and lock one another to prevent them from being pressed at the same time.

The run-on stage, like the intensive stage, can be switched on in any operating state. When the run-on stage is activated, any previously active stage is released. The run-on stage remains active for a predefined time period and then deactivates itself. In the process, the device switches off completely. The run-on stage can, like the other stages, be switched off by the switch-off or reset button 9. However, it can also be switched off by switching on another stage.

Figure 3:
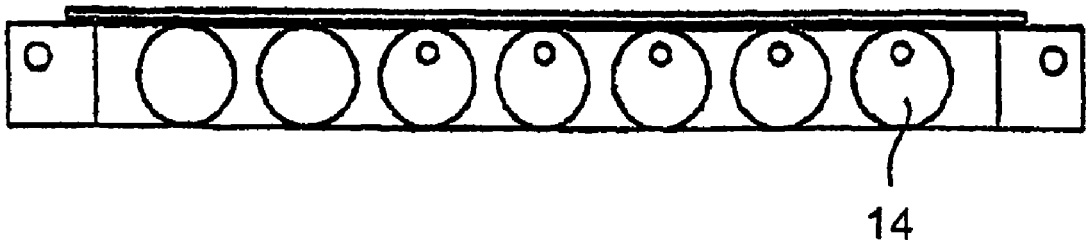
FIG. 3 is a diagrammatic, front view of a variant of the switching apparatus according to FIG. 2.

FIG. 3 shows a schematic view of a front operator control panel of a pushbutton momentary-contact switch block that constitutes a combination of the embodiments illustrated in conjunction with FIG. 2. In other words, the embodiment according to FIG. 3 contains an intensive stage and a run-on stage. For this purpose, the switch block in FIG. 2 is expanded by a pushbutton 14. Here, the momentary-contact switch for the run-on function is also mechanically connected to the momentary-contact switches of the other stages, as was also the case in the previous embodiment. The intensive stage does not have any mechanical connection to the fan stages corresponding to momentary-contact switches 10 to 12, but rather a mechanical connection to the run-on stage. This is intended to ensure that either the intensive stage or the run-on stage can be switched, but both cannot be switched simultaneously.

FIGS. 4A to 4D show perspective views of a rocker switch block according to the invention which contains four rockers 15, 16, 17 and 18 as operator control elements. In the case of an extractor hood, the rockers are assigned the following functions: the rocker switch 15 serves to switch the light of an extractor hood on and off. The blower of the extractor hood can be switched on to a stage "1" or can be switched off to a stage "0" using the rocker switch 16. By the rocker switch 17, the blower can be switched upward to a stage "2". Finally, the rocker switch 18 is used to activate an intensive stage.

Figure 4A:
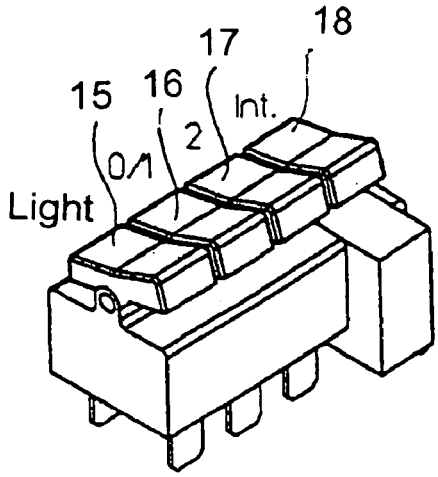
FIGS. 4A to 4D are diagrammatic, perspective views of switched states of a quadruple rocker switch according to the invention.

FIG. 4A then shows a home position of the rocker switch block. All the rockers are located in the same position here. When the stage 1 is switched on according to FIG. 4B, the rocker 16 is activated and held mechanically in position. The blower of the extractor hood then runs to stage 1.

Figure 4B:
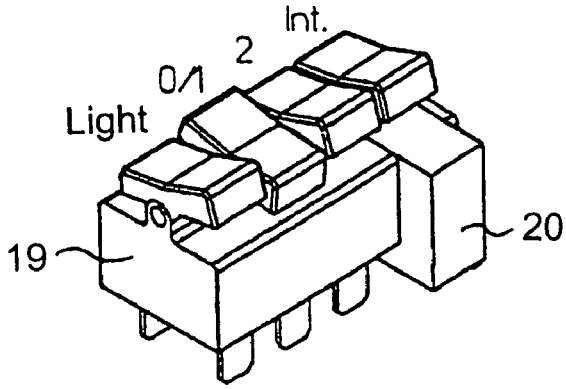
Figure 4C:
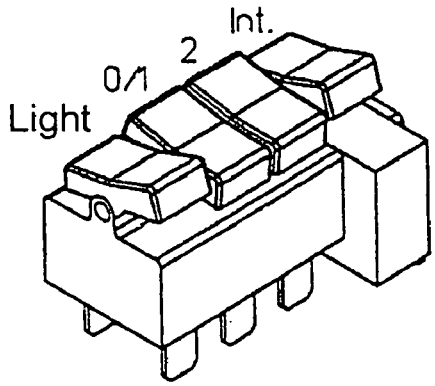

In FIG. 4C, the switching-on of the blower stage 2 is illustrated. For this purpose, the rocker 17 is activated and the rocker 16 for stage 1 remains in its switched-on position according to FIG. 4B if it was previously already switched on.

The rockers 15 to 18 can be mechanically connected to a driver in a way that is appropriate functionally with respect to one another. As a result, it is possible to bring about a situation in which, when the stage 2 is switched on directly, i.e. the stage 1 has not yet been switched on, the rocker 16 for the stage 1 is also moved into the switched-on position by the driver.

Figure 4D:
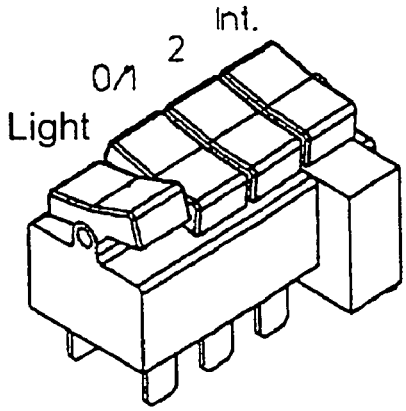

Finally, FIG. 4D shows the position of the rocker switches when the intensive stage is switched on. The rocker switch 18 for the intensive stage is, in contrast to the other switches 15 to 17, controlled in a timed fashion. Therefore, after it has been activated, it is held magnetically in the contact position. After the end of the duration of the intensive stage, the rocker 18 is moved into its home position by a spring. The intensive stage thus switches off automatically. After the automatic switching-off of the intensive stage, the rocker switch position according to FIG. 4C comes about, and the device carries on running at fan stage 2. As already explained in conjunction with stage 2, the rocker 18 for the intensive stage can also be mechanically connected to the rockers 16 and 17. As a result, the rockers 16 and 17 are moved automatically into the switched-on position according to FIG. 4D when the rocker 18 is activated.

The intensive stage can be switched off at any time by activating the rocker 18. The device then switches back to the maximum normal stage, i.e. in the present case stage 2. However, the intensive stage can also be switched off by the stage 0, i.e. the device, being switched off with the rocker 16. A housing 19 of the rocker switch block contains a cuboid receptacle 20 beneath the rocker switch 18 for mounting a time-delay switching element. In principle, the time-delay switching element is configured according to FIG. 1.

FIGS. 5A to 5D show perspective views of a quintuple rocker switch block according to the invention. The rockers 15 to 18 have the same functions as those in the quadruple rocker switch block according to FIGS. 4A to 4D. Moreover, a further timed rocker switch 21 for a run-on function is also present.

Figure 6A:
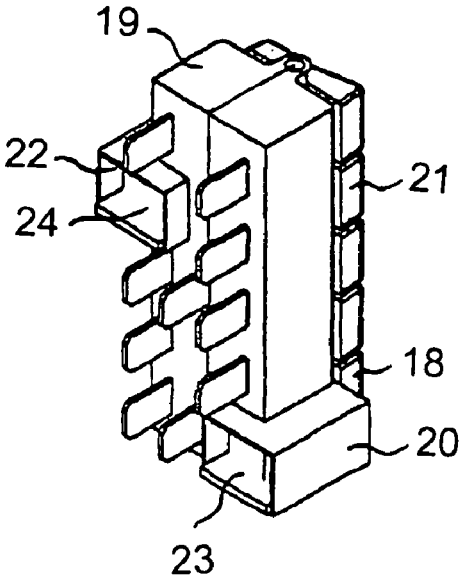
FIGS. 6A and 6B are diagrammatic, perspective views of the switch in FIGS. 5A to 5D from below.
Figure 6B:
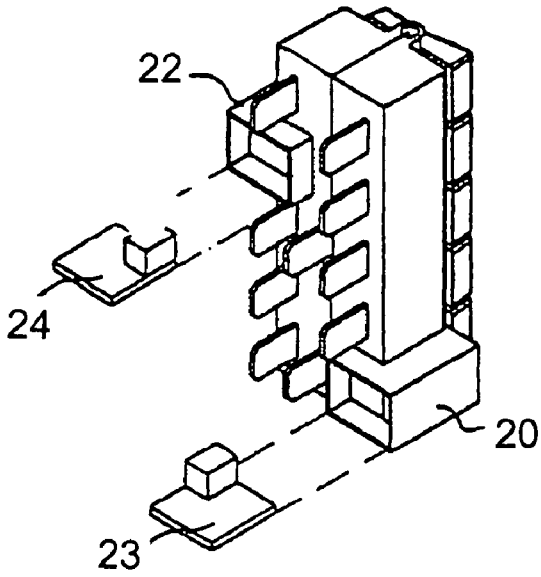

The quintuple rocker switch block correspondingly has, in addition to the time-delay switching element 23 for the intensive stage, a further time-delay switching element 24 in an additional receptacle 22 for the run-on function (see FIG. 6B).

Figure 5A:
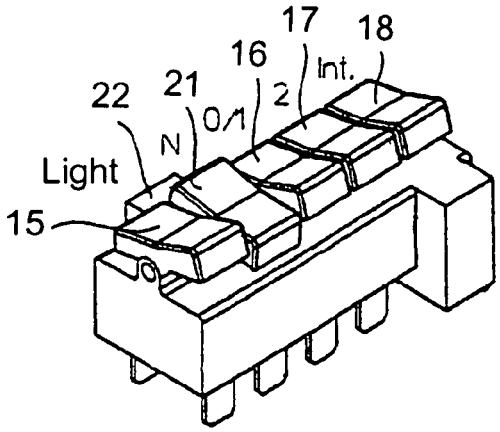
FIGS. 5A to 5D are diagrammatic, perspective views of switched states of a quintuple rocker switch according to the invention.

In the home position according to FIG. 5A, the rocker 21 for the run-on function lifts off from the position of the other rockers 15 to 18. This has proven advantageous for the operator control of an extractor hood. The rockers are mechanically connected to drivers with respect to one another in a way similar to the quadruple rocker switch block.

Figure 5B:
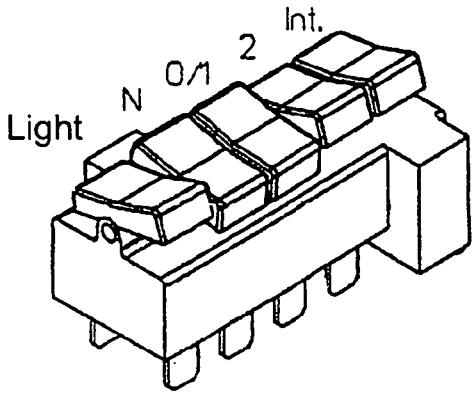
Figure 5C:
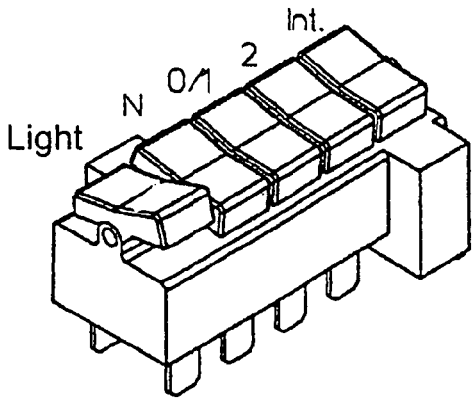
Figure 5D:
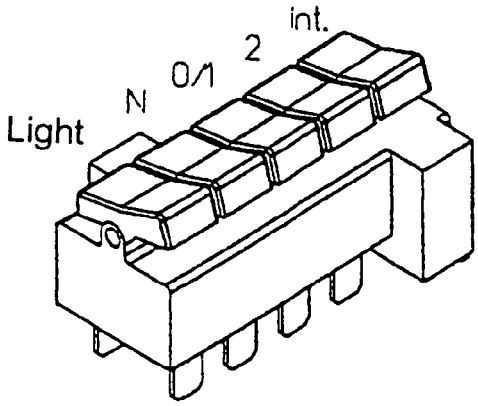

The switching of the stage 1, stage 2 and the intensive stage is carried out, as illustrated in FIGS. 5B and 5C, in accordance with the rocker switch block as described in FIGS. 4B, 4C and 4D. When the run-on function is activated, the rocker 21 is held magnetically in the contact position, as is also the case with the rocker 18 for the intensive stage. All the other rockers are moved into their zero position by a mechanical driver. This also applies to the rocker switch 18 of the intensive stage.

After the end of the run-on function, the rocker 21 is moved into its home position by a spring. After the automatic switching-off, the switch position corresponds to that in FIG. 5A.

FIGS. 6A and 6B show perspective views of the quintuple rocker switch block according to FIGS. 5A to 5D from below. The cuboid receptacle 20 for the control element 23 is provided underneath the rocker 18 for the timed intensive stage, in the base of the quintuple rocker switch block. Likewise, the cuboid receptacle 22 for the further control element 24 for the run-on function is provided underneath the rocker 21.

As is shown by the exploded view in FIG. 6B, the control elements 23 and 24 are pushed into the receptacles 20 and 22, and preferably clipped in there. The control element is pushed, by the magnet, forward through the base 19. The rocker 21 is covered on the underside with an iron-containing material that adheres to the magnet.

In summary, it is to be noted that, in this way, an electromechanical switch is implemented which in its operator control characteristic is based on the electronic control systems that have been used previously, but is significantly more cost-effective. This is possible by virtue of the fact that robust parts that are manufactured by series production are combined with modified and newly-developed components to form a push-button momentary-contact switch or a switch block with a timer function. With this novel switch it is also possible to implement device block switches with a plurality of switches. The field of use of the switch or block switch is not restricted to the field of extractor hoods but rather can also be extended to any domestic appliances, air-conditioning units, ventilation units, miniature devices, etc.

We claim:

1. A switching apparatus for controlling a device, the switching apparatus comprising:

a plurality of mechanical momentary-contact switches that mechanically switch a plurality of functionalities of the device, one of said mechanical momentary-contact switches is manually operable and resets in response to an electrical pulse and said one mechanical momentary-contact switch includes an electrical contact element and the switching apparatus further comprises an electrical opposing contact, said at least one mechanical momentary-contact switch being movably mounted relative to a housing such that said electrical contact element is movable between a contact position in which said electrical contact element is in electrical contact with said electrical opposing contact and a non-contact position in which said electrical contact element is not in electrical contact with said electrical opposing contact, the switching apparatus further comprising a biasing means for biasing said electrical contact element into the non-contact position and said biasing means being located at a spacing from said electrical opposing contact, a permanent magnet for selectively releasably maintaining said electrical contact element in electrical contact with said electrical opposing contact via a magnetic force sufficient to override the biasing force applied by said biasing means against said electrical contact element that would otherwise move said electrical contact element from its contact position into its non-contact position, and an electromagnet operable, when the electrical pulse is applied thereto, to counteract the magnetic force applied by said permanent magnet to an extent such that the magnetic force applied by said permanent magnet is no longer sufficient to override the biasing force applied by said biasing means against said electrical contact element and said biasing means moves said electrical contact element out of its contact position with said electrical opposing contact into its non-contact position in which said electrical contact element is not in electrical contact with said electrical opposing contact.

2. The switching apparatus according to claim 1, wherein at least two of said plurality of mechanical momentary-contact switches being mechanically connected to each other and said at least two mechanical momentary-contact switches are mechanically connected in a selected one of a manner in which said at least two mechanical momentary-contact switches can be reset together by the electrical pulse and a manner in which said at least two mechanical momentary-contact switches cannot be reset together by the electrical pulse.

3. The switching apparatus according to claim 2, further comprising a slide for mechanically connecting said at least two of said plurality of mechanical momentary-contact switches to each other.

4. The switching apparatus according to claim 1, wherein said plurality of mechanical momentary-contact switches are rocker switches.

5. The device according to claim 1, wherein one of said mechanical momentary-contact switches, being provided for a run-on function so that a selected functionality of the device can be switched off after a predefined time period, can be reset by the electrical pulse.

6. The device according to claim 5, wherein the functionalities of the device, including intensive operating stages, can be freely selectable during the run-on.

7. The device according to claim 1, wherein said at least one mechanical momentary-contact switch is provided with a run-on function such that a selected functionality of the device can be switched off after a predefined time period via application of the electrical pulse.

8. The device according to claim 1, further comprising means for mechanically connecting said at least one mechanical momentary-contact switch and another of said mechanical momentary-contact switches to each other such that these mechanical momentary-contact switches can be reset by the electrical pulse.

9. The device according to claim 1, wherein the switching apparatus is connected to and controls a unit selected from the group consisting of air-conditioning units and ventilation units.

10. The device according to claim 1, wherein the switching apparatus is connected to and controls a domestic appliance.

11. A device, comprising:

a unit selected from the group consisting of air-conditioning units and ventilation units; and a switching apparatus connected and controlling said unit, said switching apparatus containing a plurality of mechanical momentary-contact switches that mechanically switch a plurality of functionalities of the device, one of said mechanical momentary-contact switches is manually operable and resets in response to an electrical pulse and said one mechanical momentary-contact switch includes an electrical contact element and the switching apparatus further comprises an electrical opposing contact, said at least one mechanical momentary-contact switch being movably mounted relative to a housing such that said electrical contact element is movable between a contact position in which said electrical contact element is in electrical contact with said electrical opposing contact and a non-contact position in which said electrical contact element is not in electrical contact with said electrical opposing contact, the switching apparatus further comprising a biasing means for biasing said electrical contact element into the non-contact position and said biasing means being located at a spacing from said electrical opposing contact, a permanent magnet for selectively releasably maintaining said electrical contact element in electrical contact with said electrical opposing contact via a magnetic force sufficient to override the biasing force applied by said biasing means against said electrical contact element that would otherwise move said electrical contact element from its contact position into its non-contact position, and an electromagnet operable, when the electrical pulse is applied thereto, to counteract the magnetic force applied by said permanent magnet to an extent such that the magnetic force applied by said permanent magnet is no longer sufficient to override the biasing force applied by said biasing means against said electrical contact element and said biasing means moves said electrical contact element out of its contact position with said electrical opposing contact into its non-contact position in which said electrical contact element is not in electrical contact with said electrical opposing contact.

12. The device according to claim 11, wherein: said unit has a plurality of intensive stages each being capable of being switched on and off by said mechanical momentary-contact switches; and one of said mechanical momentary-contact switches functions as an electrically resettable switch capable of switching off one of the intensive stages in a way which is timed using the electrical pulse.

13. The device according to claim 11, wherein one of said mechanical momentary-contact switches, being provided for a run-on function so that a selected functionality of the device can be switched off after a predefined time, can be reset by the electrical pulse.

14. The device according to claim 13, wherein the functionalities of the device, including the intensive stages, can be freely selectable during the run-on.

15. The device according to claim 11, wherein said mechanical momentary-contact switches are pushbutton momentary-contact switches.

16. The device according to claim 11, wherein the device is a domestic appliance.

17. A switching apparatus for controlling a device, the switching apparatus comprising:

a plurality of mechanical momentary-contact switches that mechanically switch a plurality of functionalities of the device, one of said mechanical momentary-contact switches is manually operable and resets in response to an electrical pulse and the one of said mechanical momentary-contact switches comprises:

a momentary-contact;

a housing;

a helical compression spring coiled around the momentary-contact and biasing the momentary-contact away from the housing;

an electrical contact on the momentary-contact;

an electrical opposing contact opposing the electrical contact in an axial direction of the momentary-contact;

an electromagnet surrounding the electrical opposing contact; and a permanent magnet on the electrical opposing contact, wherein the permanent magnet provides a magnetic force that holds the electrical contact in contact with the electrical opposing contact against the biasing force of the helical compression spring to establish an electrical circuit through the contact between the electrical contact and the electrical opposing contact and wherein the electromagnet is responsive to an electrical pulse to generate an opposing magnetic force such that the biasing force of the helical compression spring releases the electrical contact from contact with the electrical opposing contact to disconnect the electrical circuit.

18. The switching apparatus according to claim 17, wherein the switching apparatus is connected to and controls a unit selected from the group consisting of air-conditioning units and ventilation units.

19. The switching apparatus according to claim 17, wherein the switching apparatus is connected to and controls a domestic appliance.

* * * * *